United States Patent [19]

Rokutanda et al.

[11] Patent Number: 4,927,734

[45] Date of Patent: May 22, 1990

[54] SILVER HALIDE PHOTOGRAPHIC LIGHT-SENSITIVE MATERIAL AND A PROCESS FOR FORMING A HIGH CONTRAST PHOTOGRAPHIC IMAGE

[75] Inventors: Shuji Rokutanda, Tokyo; Yasuo Shigemitsu, Ohmiya; Akiyoshi Tsuchida, Kitamoto; Yukihiro Yamakoshi, Urawa, all of Japan

[73] Assignee: Dainippon Ink. and Chemicals, Inc., Tokyo, Japan

[21] Appl. No.: 274,223

[22] Filed: Nov. 21, 1988

[30] Foreign Application Priority Data

Dec. 25, 1987 [JP] Japan ..... 62-326855

[51] Int. Cl.[5] ..... G03C 1/33

[52] U.S. Cl. ..... 430/264; 430/267; 430/442; 430/446; 430/440; 430/598

[58] Field of Search ..... 430/264, 267, 442, 446, 430/440, 598

[56] References Cited

U.S. PATENT DOCUMENTS

| | | | |
|---|---|---|---|
| 3,793,027 | 2/1974 | Okutsu | 96/66 R |
| 4,221,857 | 9/1980 | Okutsu | 430/264 |
| 4,237,214 | 12/1980 | Mifune | 430/441 |
| 4,272,606 | 6/1981 | Mifune | 430/264 |
| 4,272,614 | 6/1981 | Mifune | 430/441 |
| 4,332,878 | 6/1982 | Akimura | 430/264 |
| 4,377,634 | 3/1983 | Mifune | 430/440 |
| 4,459,347 | 7/1984 | Parton | 430/217 |
| 4,478,928 | 10/1984 | Hess | 430/217 |
| 4,560,638 | 12/1985 | Loblaw | 430/264 |
| 4,569,909 | 2/1986 | Okutsu et al. | 430/446 |
| 4,618,574 | 10/1986 | Cavallaro | 430/567 |
| 4,634,661 | 1/1987 | Cavallaro | 430/567 |
| 4,668,605 | 5/1987 | Okutsu | 430/267 |
| 4,686,167 | 8/1987 | Resnick | 430/264 |
| 4,699,873 | 10/1987 | Takahashi | 430/446 |
| 4,722,884 | 2/1988 | Inoue et al. | 430/446 |
| 4,725,532 | 2/1988 | Kameoka | 430/566 |
| 4,737,422 | 4/1988 | Yagihara | 430/264 |
| 4,740,452 | 4/1988 | Okutsu | 430/439 |
| 4,755,448 | 7/1988 | Katoh | 430/266 |
| 4,755,449 | 7/1988 | Inoue et al. | 430/446 |
| 4,756,997 | 7/1988 | Marchesano | 430/478 |
| 4,800,150 | 1/1989 | Katoh | 430/264 |

FOREIGN PATENT DOCUMENTS

| | | |
|---|---|---|
| 61-230145 | 4/1986 | Japan . |
| 62-222241 | 3/1987 | Japan . |
| 63-226636 | 1/1988 | Japan . |

*Primary Examiner*—Richard L. Schilling
*Assistant Examiner*—T. Chea
*Attorney, Agent, or Firm*—Armstrong, Nikaido, Marmelstein, Kubovcik & Murray

[57] ABSTRACT

A silver halide photographic light-sensitive material contains at least one negative-working silver halide emulsion layer composed of substantially surface latent image type monodispersed silver halide grains. The emulsion layer or another hydrophilic colloidal layer contains a compound of general formula I or II:

[I]

[II]

wherein each of $R_1$, $R_2$, $R_3$, and $R_4$ represents a hydrogen atom, or a substituted or unsubstituted alkyl or aryl group, and if one of $R_3$ and $R_4$ is a hydrogen atom, the other thereof is not a hydrogen atom. Disclosed also is a process which forms a photographic image by employing the material as described above, or a developer containing the compound as shown above.

61 Claims, No Drawings

SILVER HALIDE PHOTOGRAPHIC LIGHT-SENSITIVE MATERIAL AND A PROCESS FOR FORMING A HIGH CONTRAST PHOTOGRAPHIC IMAGE

BACKGROUND OF THE INVENTION

1. Field of the Invention:

This invention relates to a silver halide photographic light-sensitive material and a process for forming a high contrast photographic image. More particularly, it is a process for forming a high contrast negative image which is suitable for use in a photomechanical process for making a photographic printing plate.

2. Description of the Prior Art:

A photomechanical process is required to form a sharp dot or line image and therefore must use a system which can form a high contrast image particularly having a gamma value of at least 10. Accordingly, it has been usual to employ a lith type silver halide photographic light-sensitive material comprising a silver chlorobromide emulsion containing over 50 mol %, or preferably over 70 mol %, of silver chloride and treat it with a so called lith developer containing only hydroquinone as a developing agent and having a very low free sulfite ion concentration usually not exceeding 0.1 mol per liter. This developer is, however, very unstable due to its low sulfite ion concentration. A lith developer is easily oxidized with air and causes a drastic deterioration in quality within only a few days. Moreover, the use of the emulsion having such a high silver chloride content makes it difficult to achieve high sensitivity.

U.S. Pat. Nos. 4,168,977, 4,224,401, 4,241,164, 4,269,929, 4,311,781, and 4,650,746 disclose processes which employ specific hydrazine derivatives and stable developers to form a high contrast image. These processes employ silver halide photographic light-sensitive materials of the surface latent image type containing specific hydrazine derivatives (usually acylphenylhydrazine derivatives) as nucleating agents and treat them with stable developers containing at least 0.5 mol of sulfite ion per liter and having a pH of 11 to 12.3 to form a high contrast impage having a gamma value of over 10. The presence of a high concentration of sulfite ion in these developers greatly improves their storage stability over that of the lith developers.

These processes can form a high contrast negative image, but have also been found to present a number of problems including the appearance of "pepper" which causes a serious problem in a photomechanical process for making printing plates. The pepper is a black spot which appears in an unexposed area, such as an area between dots which is not to be developed. The appearance of pepper seriously lowers the commercial value of graphic arts materials. A great deal of efforts have, therefore, been made to explore techniques for preventing the appearance of pepper, but the improvement in pepper susceptibility has often resulted in a reduction in sensitivity and gamma value. Accordingly, it has been a strong desire to develop a system which can form a high contrast impage having high sensitivity without the appearance of any pepper.

SUMMARY OF THE INVENTION

It is, therefore, an object of this invention to provide a silver halide photographic light-sensitive material which can form a very high contrast negative image having a gamma value of over 10 and substantially free from any pepper.

It is another object of this invention to provide a process which can form a very high contrast negative image having a gamma value of over 10 and substantially free from any pepper.

These objects are essentially attained by the use of a novel nucleating agent for forming a development center. More specifically, they are attained by:

(1) A material containing at least one negative-working silver halide photographic emulsion layer comprising substantially surface latent image type monodispersed silver halide grains, the said emulsion layer or another hydrophilic colloidal layer containing a compound of general formula I or II:

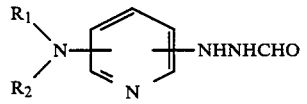

[I]

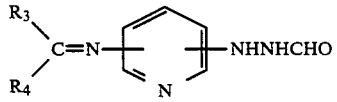

[II]

wherein each of $R_1$, $R_2$, $R_3$ and $R_4$ represents a hydrogen atom, a substituted or unsubstituted alkyl group, or a substituted or unsubstituted aryl group, provided, however, that if one of $R_3$ and $R_4$ is a hydrogen atom, the other cannot be a hydrogen atom;

(2) A process for forming a high contrast negative image wherein a material as set forth in (1) above is exposed to an image-wise pattern of light and then treated with a developer containing at least 0.15 mol of sulfite ion per liter and having a pH of 11 to 12.5; and (3) A process for forming a high contrast negative image wherein a photographic light-sensitive material containing at least one negative-working silver halide photographic emulsion layer comprising substantially surface latent image type monodispersed silver halide grains is exposed to an image-wise pattern of light and then treated with a developer containing a compound of formula I or II above and at least 0.15 mol of sulfite ion per liter and having a pH of 11 to 12.5.

The material and process of this invention can form a high contrast image free from pepper which is particularly useful for the preparation of a photographic printing plate.

Other features and advantages of this invention will become apparent from the following description.

DETAILED DESCRIPTION OF THE INVENTION

This invention is essentially characterized by employing a compound of general formula I or II:

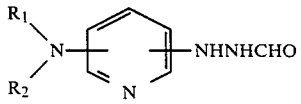

[I]

-continued

[II]

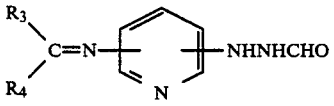

Each of $R_1$ and $R_2$ in formula I and $R_3$ and $R_4$ in formula II represents a hydrogen atom, a linear, branched or cyclic unsubstituted or substituted alkyl group having 1 to 20 carbon atoms, or a monocyclic or bicyclic unsubstituted or substituted aryl group. However, if $R_3$ is a hydrogen atom, $R_4$ is not a hydrogen atom, but is an alkyl or aryl group, and vice versa.

Specific examples of the unsubstituted alkyl groups which can be employed include methyl, ethyl, n-propyl, iso-propyl, n-butyl, tert-butyl, n-hexyl, cyclohexyl and cyclopentyl groups. These alkyl groups may have a substituent such as an aryl group, a heterocyclic or heterocyclicthio group, a hydroxyl group, a halogen atom, and an alkoxy group. Specific examples of the aryl group are an alkyl-substituted phenyl group whose alkyl moiety contains from 1 to 5 carbon atoms (e.g., 4-methylphenyl, 3-ethylphenyl, 4-t-butylphenyl, etc), a halogen-substituted phenyl group (e.g., 4-chlorophenyl, 4-bromophenyl, etc) a hydroxyphenyl group (e.g., 4-hydroxyphenyl, 3-hydroxyphenyl, etc), an alkoxyphenyl group whose alkoxyl moiety contains from 1 to 10 carbon atoms (e.g., 4-methoxyphenyl, 3-ethoxyphenyl, etc), an aryloxyphenyl group (e.g., 3-phenoxyphenyl, 4-phenoxyphenyl, etc), an alkylthiophenyl group whose alkyl moiety contains from 1 to 10 carbon atoms (e.g., 4-methylthiophenyl, 4-ethylthiophenyl, etc), an amino- or substituted aminophenyl group (e.g., 4-aminophenyl, 4-N,N-dimethylaminophenyl, etc), an acylaminophenyl group (e.g., 4-acetylaminophenyl, 4-benzoylaminophenyl, etc), and an ureidophenyl group (e.g., 4-N,N-dimethylureidophenyl, 3-N,N-diethylureidophenyl, etc).

Specific examples of the heterocyclic group are a triazolyl group, a benzotriazolyl group, a tetrazoyl group, a thiazoyl group, a benzothiazolyl group, a benzimidazolyl group, an indazoyl group, an oxazoyl group etc. These heterocyclic groups may have substituents such as an alkyl group having 1 to 5 carbon atoms, a halogen atom, a mercapto group, a nitro group etc.

Specific examples of the substituted alkyl group represented by $R_1$ or $R_2$ in formula I, or $R_3$ or $R_4$ in formula II, are benzyl, phenethyl, 2-chloroethyl, 2-methoxyethyl, 2-hydroxyethyl, 4-methylbenzyl, 4-isopropylbenzyl, 4-hydroxybenzyl, 4-methoxybenzyl, 4-aminobenzyl, 4-N,N-dimethylureidobenzyl, 3,5-di-t-butyl-4-hydroxybenzyl, 4-methylthiobenzyl, 1-naphthylmethyl, 1-benzotriazoylmethyl, 5-methylbenzotriazol-l-yl methyl, 1-phenyl-tetrazoyl-5-yl-thiomethyl, and 5-nitro-indazol3-yl methyl groups.

Specific examples of the unsubstituted aryl group represented by $R_1$ or $R_2$ in formula I, or $R_3$ or $R_4$ in formula II, are a phenyl group and a naphthyl group. These aryl groups may be substituted with a suitable substituent such as an alkyl group having 1 to 10 carbon atoms, a halogen atom, a hydroxyl group, an alkoxyl group or an alkylthio group having 1 to 10 carbon atoms, an amino- or substituted amino group, an acylamino group, or an ureido group. Specific examples of the substituted aryl group are 4-methylphenyl, 3-methylphenyl, 2-methylphenyl, 4-isopropylphenyl, 4-chlorophenyl, 2-chlorophenyl, 4-methoxyphenyl, 4-methylthiophenyl, 4-aminophenyl, 4-acetylaminophenyl, 4-hydroxyphenyl, 2-hydroxyphenyl, 4-N,N-dimethylureidophenyl, 5-chloro-1-naphthyl, and 5-methoxy-1-naphthyl groups.

The formylhydrazino group in formula I or II may be introduced by substitution to any of the 2 to 6 positions of the pyridine ring, though it is preferably located in the 2 position thereof.

The following formulas represent typical examples of the compounds which can be represented by formulas I and II:

I-1

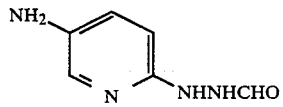

I-2

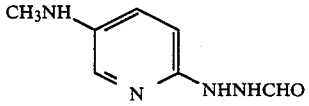

I-3

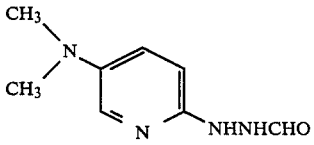

I-4

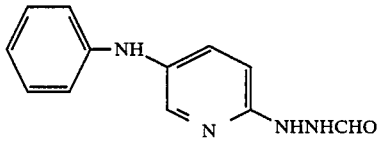

I-5

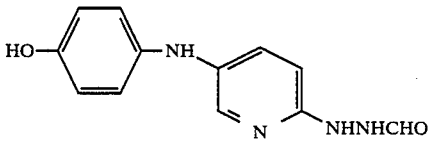

I-6

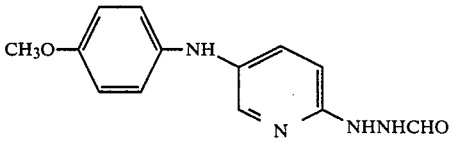

I-7

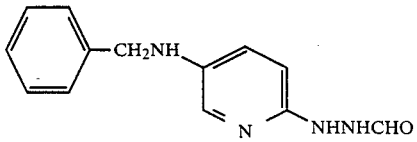

I-8

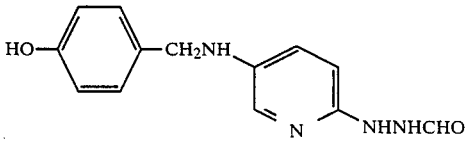

I-9

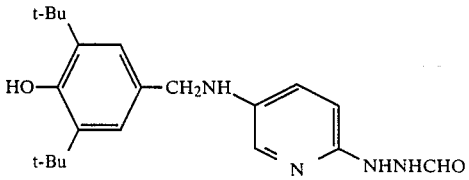

(t-Bu: tertiary butyl group)

-continued
I-10
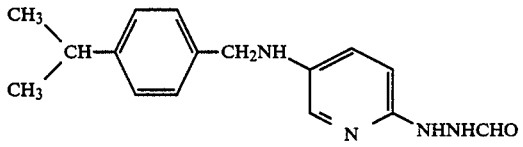
I-11
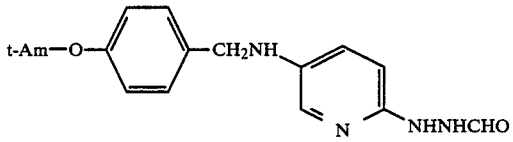
(t-Am: tertiary amyl group)
I-12
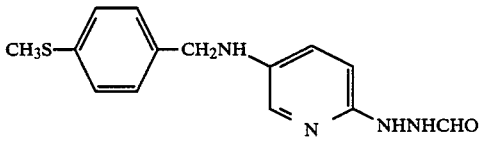
I-13
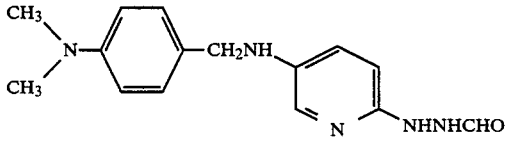
I-14
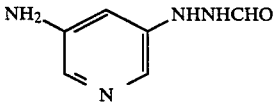
I-15
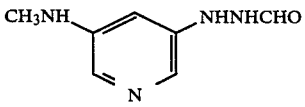
I-16
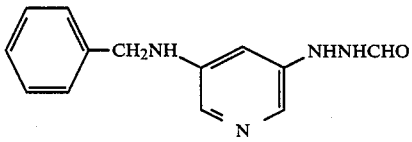
I-17
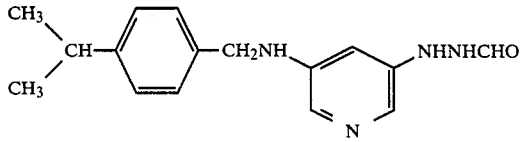
I-18
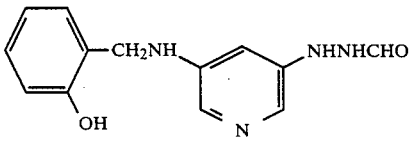
I-19
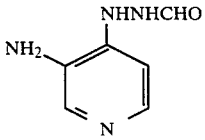
-continued
I-20
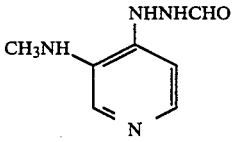
I-21
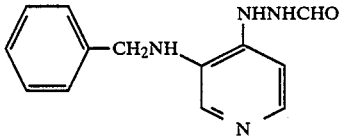
I-22
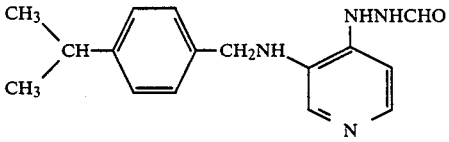
I-23
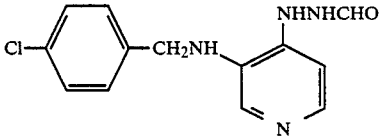
I-24
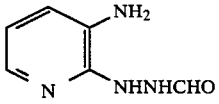
I-25
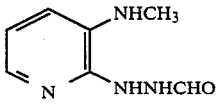
I-26
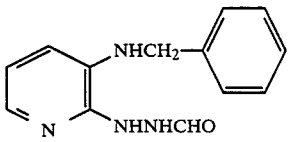
I-27
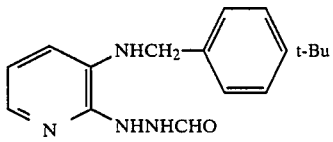
(t-Bu: tertiary butyl group)
I-28
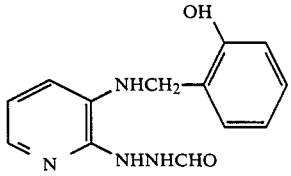
I-29
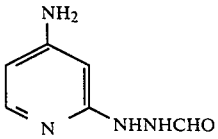

-continued
I-30
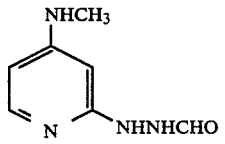
I-31
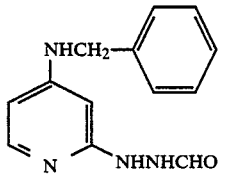
I-32
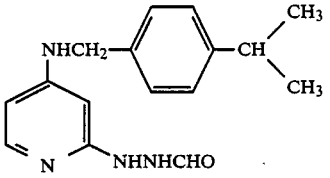
I-33
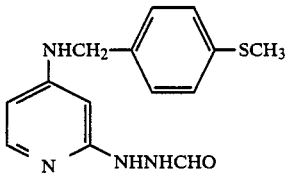
I-34
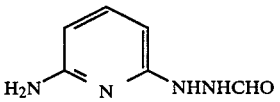
I-35
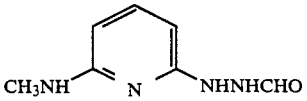
I-36
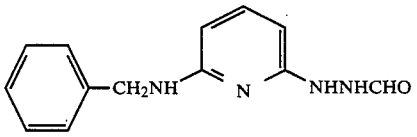
I-37
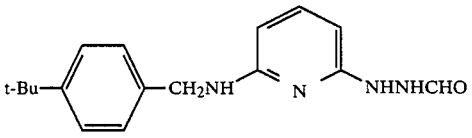
I-38
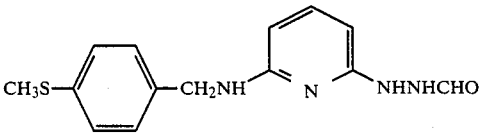
I-39
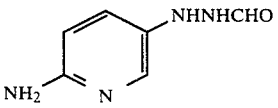
-continued
I-40
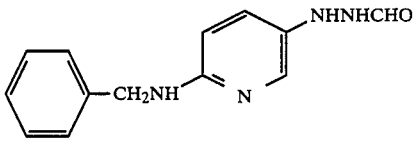
I-41
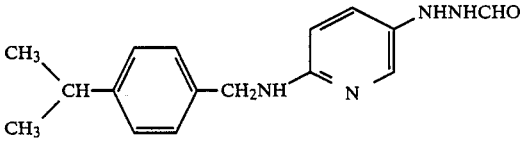
I-42
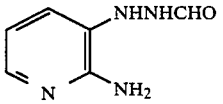
I-43
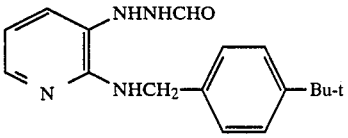
I-44
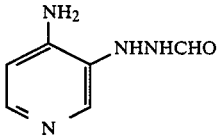
I-45
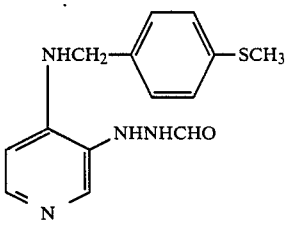
I-46
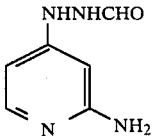
I-47
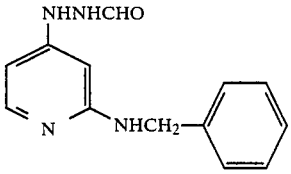
I-48
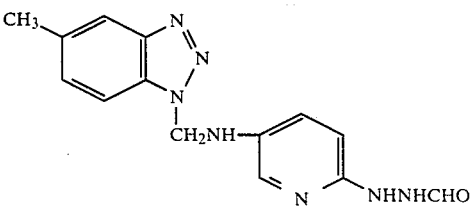

-continued
I-49
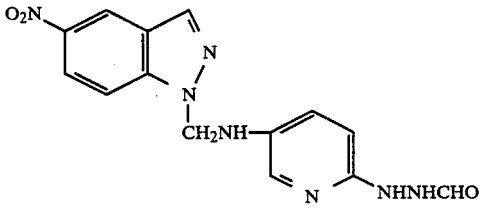
I-50
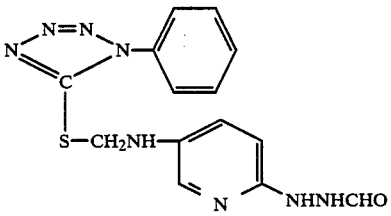
II-1
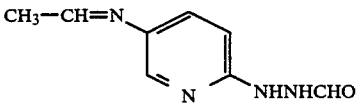
II-2
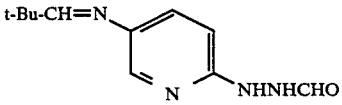
II-3
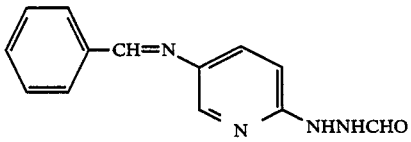
II-4
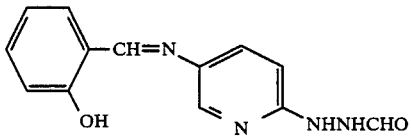
II-5
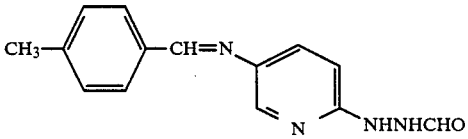
II-6
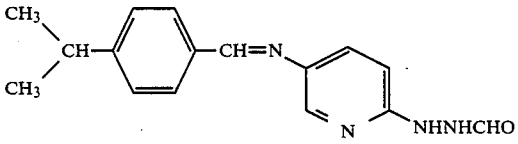
II-7
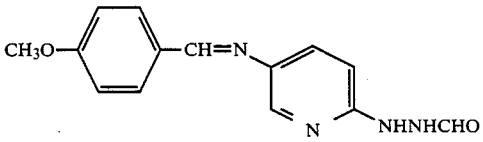
II-8
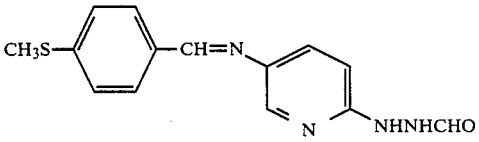
-continued
II-9
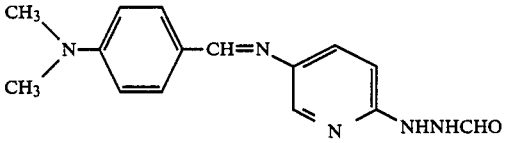
II-10
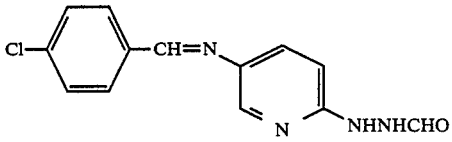
II-11
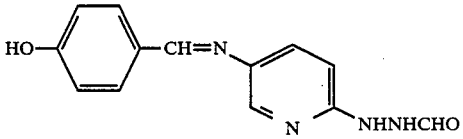
II-12
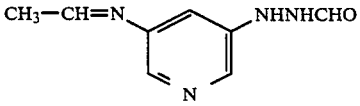
II-13
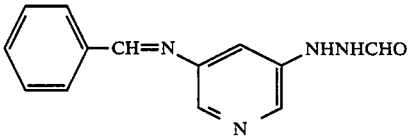
II-14
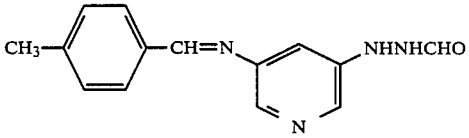
II-15
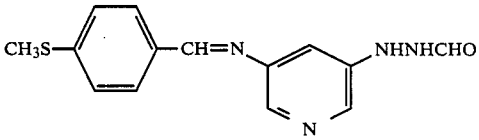
II-16
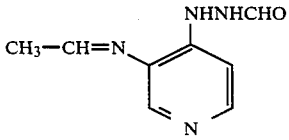
II-17
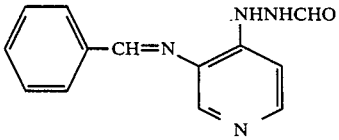
II-18
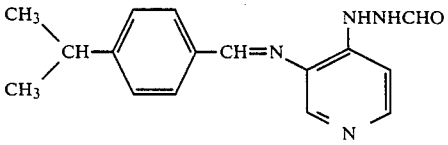

-continued

II-19

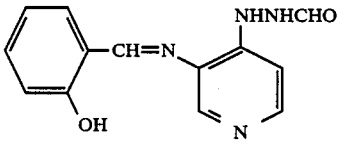

II-20

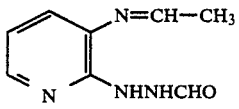

II-21

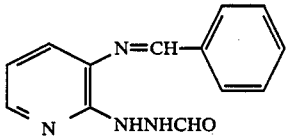

II-22

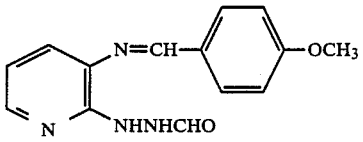

II-23

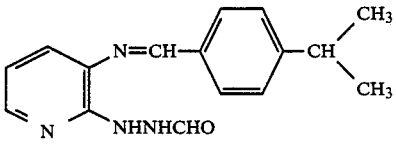

II-24

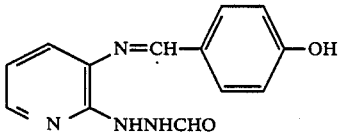

II-25

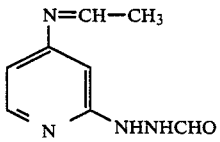

II-26

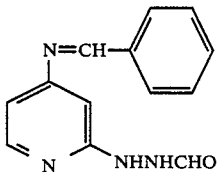

II-27

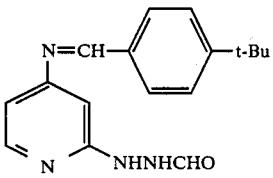

II-28

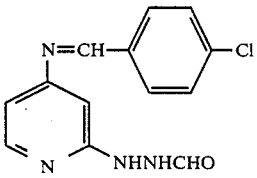

-continued

II-29

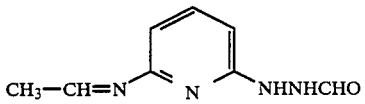

II-30

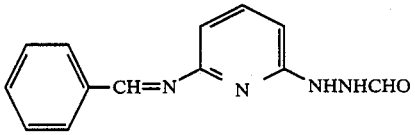

II-31

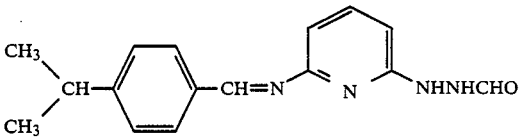

II-32

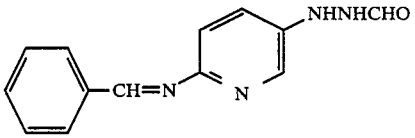

II-33

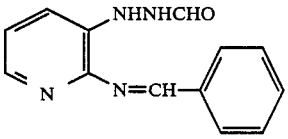

II-34

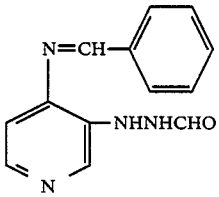

II-35

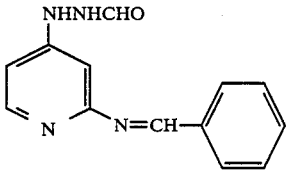

The compound of formula I or II may be incorporated in either the photographic light-sensitive material or the developer. However, it is preferably incorporated in the former. In this case it can be incorporated in either a surface latent image type silver halide photographic emulsion layer, or another hydrophilic colloidal photographic emulsion layer or other layer that is not sensitive to light, such as a protective layer, an interlayer, an anti-halation, or a filter layer. It is, however, preferable to incorporate it in the surface latent image type silver halide photographic emulsion of this invention.

The compound represented by formula I or II can be added to the photographic emulsion at any time after the emulsion has started its chemical ripening, and before it is coated on a base. Most desirably the compound may be added to the photographic emulsion at the end of its chemical ripening.

The addition of the compound represented by formula I or II to the photographic light-sensitive material can be made by employing any method that is usually employed for incorporating an additive into a photographic emulsion. For example, a solution of the compound can be added to a negative-working silver halide photographic emulsion of this invention or a hydrophilic colloidal solution which is not sensitive to light. The solution may be either an aqueous solution if the compound is soluble in water, or one prepared by using an appropriate organic solvent which is miscible with water, such as an alcohol, ketone, ester or amide, if it is insoluble or sparingly soluble in water.

The amount of the compound represented by formula I or II which can be added to the photographic light-sensitive material depends on the grain size and the halogen composition of the silver halide emulsion, the method employed for its chemical sensitization, the degree to which it is sensitized, the kind of antifoggant employed, etc. The optimum amount may usually range from $10^{-5}$ to $10^{-1}$ mol, and preferably from $10^{-3}$ to $5\times10^{-2}$ mol, per mol of silver halide.

The advantage of the compound represented by formula I or II as a nucleating agent is to form a very high contrast image without appearance of any pepper, when it is added to the silver halide emulsion. On the other hand, it is impossible to obtain a high contrast image when using any known heterocyclic hydrazine derivatives, such as 2-(2-formylhydrazino)benzothiazole, 2-(2-formylhydrazino)-4,6-di-ethylamino-s-triazine and 2-(2-formylhydrazino)-4,6-di-methoxy-s-triazine, which are disclosed in Japanese Patent Applications Nos. 83028/1985, 93433/1985 and 222241/1987 and U.S. Pat. No. 4,681,836. Moreover, the compound of formula I or II is a nucleating agent for forming a development center which is by far superior to and known arylhydrazine derivative, as it is by far less likely to cause the appearance of pepper.

The silver halide grains in the silver halide photographic emulsion according to this invention are silver chloride, silver bromide, silver chlorobromide, silver iodobromide or silver iodochlorobromide grains of the surface latent image type. However, the halide composition is desirably at least 50 mol % bromide, and preferably not less than 70 mol % bromide. Furthermore, the iodide content therein is desirably 10 mol % or less, and preferably 5 mol % or less.

The silver halide emulsion which can be used for the purpose of this invention is a monodispersed emulsion in which the silver halide grains have an average size of 0.1 to 0.7 micron, and the grain sizes of 90% of all silver halide grains fall within the range of ±40% of the mean grain size.

The silver halide grains can be prepared by any known method. An acidic, neutral or ammoniacal process can be employed. A normal, reverse or simultaneous mixing process, or a combination thereof can be employed for reacting a soluble silver salt and a soluble halogen salt. A good example of the simultaneous processes is the pAg controlled double jet process in which the silver ion concentration (pAg) of the liquid phase in which silver halide grains are to be precipitated is maintained at a constant level. This process enables the formation of a monodispersed emulsion of uniformly shaped silver halide crystals having a substantially uniform grain size. The formation or physical ripening of silver halide grains in the presence of a cadmium, iridium or rhodium salt provides a silver halide emulsion having a high contrast.

The silver halide emulsion layer contains a binder in a quantity preferably not exceeding 250 g per mol of silver halide. Gelatin is the best binder, though it is also possible to use another hydrophilic colloid, such as albumin, casein, a graft polymer prepared from gelatin and another high polymer, polyvinyl alcohol, polyacrylamide, or other hydrophilic polymer.

The silver halide emulsion of this invention is usually subjected to chemical sensitization, though it is not essential. A method utilizing a sulfur compound, a reducing agent or a complex of a noble metal, or a combination thereof can be employed for the chemical sensitization of the emulsion. For the purpose of this invention, however, it is preferable to employ a method utilizing a sulfur compound, or a combination of a sulfur compound and gold compound. Active gelatin, thiosulfate, thiourea or allylthiocarbamide can, for example, be used as a sulfur-sensitizer, while $HAuCl_4$, or $Au(SCN)_2^-$ or $Au(S_2O_3)_2^{3-}$ salt can, for example, be used as a goldsensitizer.

The silver halide emulsion of the present invention is subjected to spectral sensitization by one or more sensitizing dyes so that it provides spectral sensitivity in a desired wavelength range. More specifically, it is possible to use, for example, cyanine, merocyanine styryl, hemicyanine, holopolar cyanine, oxonol and hemioxonol dyes. Cyanine and merocyanine dyes are particularly useful. For the basic heterocyclic nuclei of the dyes, it is possible to use any of the nuclei which are usually employed in cyanine dyes. More specifically, it is possible to use, for example, pyrroline, oxazole, oxazoline, thiazole, thiazoline, pyrrole, selenazole, imidazole, tetrazole, pyridine, indole, benzoxazole, benzothiazole, benzoselenazole, benzimidazole and quinoline nuclei.

The photographic light-sensitive material of this invention comprises at least one hydrophilic colloidal layer containing a silver halide emulsion coated on a support. It may also include another light-insensitive hydrophilic colloidal layer, such as a protective layer, an interlayer, an anti-halation layer or a filter layer. The hydrophilic colloidal layer may contain an inorganic or organic hardener. More specifically, it may contain, for example, a chromium salt (such as chrome alum), an aldehyde (such as formaldehyde or glyoxal), an N-methylol compound (such as dimethylolurea or methyloldimethylhydantoin), an active halogen compound (such as 2,4-dichloro-6-hydroxy-s-triazine or mucochloric acid), an active vinyl compound (such as 1,3,5-triacryloyl-hexahydro-s-triazine), or an epoxy or aziridine hardener.

The hydrophilic colloidal layer can further contain various kinds of photographic additives, if required, and to the extent that they do not adversely affect the results which this invention is intended to produce. They include an emulsion stabilizer (a hydroxytetraazainedene compound such as 6-hydroxy-4-methyl-1,3,3a,7-tetraazainedene), a spreading agent (such as saponin), a gelatin plasticizer (such as an acrylate copolymer), an antistatic agent, a coating assistant, a surface active agent (cationic, anionic, non-ionic or amphoteric) for improving photographic characteristics (e.g., accelerating development or improving gamma), an antifoggant (such as 5-methylbenzotriazole or 1-phenyl5-mercaptotetrazole), a matting agent, and a water-insoluble or sparingly soluble polymer latex (a homopolymer or copolymer, such as alkyl acrylate or methacrylate, acrylic acid, or glycidyl acrylate) for improving the dimensional stability of the photographic light-sensitive material.

Any known method can be employed for the photographic processing of the imagewise exposed light-sensitive material. Any known processing solution can be employed. A processing temperature of 18° C. to 50° C. is preferred.

The developer which is used for the purpose of this invention can contain known developing agents. More specifically, it can, for example, contain a dihydroxybenzene (e.g., hydroquinone), a 3-pyrazolidone (e.g., 1-phenyl-3-pyrazolidone), or an aminophenol (e.g., N-methyl-p-aminophenol). It is particularly preferable to use a developer which contains hydroquinone with a 3-pyrazolidone (PQ type) or hydroquinone with an aminophenol (MQ type).

The developer contains at least 0.15 mol, or preferably at least 0.25 mol, of free sulfite ion per liter. Sulfite, such as sodium or potassium sulfite, can be used for supplying the sulfite ion. The developer may further contain a preservative (e.g., hydroxylamine), an alkali agent, an inorganic antifoggant (e.g., potassium or sodium bromide), an organic antifoggant (e.g., 5-nitroindazole or 5-methylbenzotriazole), a development accelerator (e.g., alkanolamine), a pH buffer (e.g., sodium or potassium phosphate), a water softener (e.g., sodium ethylenediaminetetraacetate), a surface active agent, a toning agent, a defoaming agent, etc., which are all known in the art.

The pH of developer is adjusted to the range of from 11 to 12.5, preferably from 11.5 to 12.3. The use of a developer having a pH below 11 would make it difficult to form a high contrast image as intended by this invention. A developer having a pH above 12.5 would become unstable even though it has the high sulfite ion concentration and would not be able to provide any stable photographic characteristics for a period of over three days when used in an ordinary way.

The invention will now be described in further detail with reference to several examples thereof. It is, however, to be understood that these examples are not intended to limit the scope of this invention which is defined by the appended claims.

EXAMPLE 1

A monodispersed cubic silver bromide emulsion having a mean grain size of 0.2 micron was prepared by adding an aqueous solution of silver nitrate and an aqueous solution of potassium bromide simultaneously to an aqueous solution of gelatin at 60° C. over a period of 60 minutes, while maintaining a pAg value of 7.0. After the soluble salts had been removed in a conventional way, sodium thiosulfate and $HAuCl_4$ were added to the emulsion in a quantity of $2.5\times10^{-4}$ mol and $5\times10^{-5}$ mol, respectively, per mol of silver bromide and the emulsion was subjected to 90 minutes of chemical ripening at 60° C. The emulsion contained 85 g of gelatin per mol of silver bromide. It was substantially an emulsion of the surface latent image type, as its internal sensitivity was negligibly low as compared with its surface sensitivity.

Then, 6-hydroxy-4-methyl-1,3,3*a*,7-tetraazainedene and anhydro-5,5'-dichloro-9-ethyl-3,3'-bis(3-sulfopropyl)-oxacarbocyanine triethylammonium salt were added to the emulsion in a quantity of 1.9 g and $4.2\times10^{-4}$ mol, respectively, per mol of silver bromide. Each of various compounds of formula I or II were then added to the divided emulsion as shown in TABLE 1. Then, each emulsion was coated on a polyethylene terephthalate (PET) base to form an emulsion layer containing 40 mg of silver per 100 $cm^2$. The emulsion layer was covered with an overcoat layer containing 1-methylol-5,5-dimethylhydantoin as a hardener. Thus, a variety of samples of film Nos. 1 to 21-d) were prepared. Some of them were coated with emulsions containing a comparative compound, as shown in TABLE 1.

Each of the samples was exposed for 10 seconds to 2666K tungsten light through LB-200 and ND-10 filters and a step wedge having a step of 0.15. The exposed film was developed by a developer of the composition shown below at 29.4° C. for 160 seconds, and was thereafter processed in a conventional way.

| | | |
|---|---|---|
| N-methyl-p-aminophenol hemisulfate | 2.0 | g |
| Hydroquinone | 40.0 | g |
| Anhydrous sodium sulfite | 75.0 | g |
| Potassium bromide | 3.5 | g |
| 2-diethylaminoethanol | 46.8 | g |
| Disodium ethylenediaminetetraacetate | 1.0 | g |
| Sodium hydrogencarbonate | 7.0 | g |
| 48% potassium hydroxide | 70.0 | g |
| 5-methylbenzotriazole | 0.8 | g |
| Water to make | 1 | liter |
| pH | 12.0 | |

The photographic characteristics thereby obtained are shown in TABLE 2. In TABLE 2, the "relative sensitivity" representes a relative value showing the reciprocal of the amount of exposure required for obtaining a density of 3.0 above the fog density, when the relative sensitivity of Sample No. 1 is shown as 100. The contrast (gamma value) is shown by the average gradient of the straight portion of the photographic characteristic curve. The unexposed area of each film was examined for pepper by a loupe having a magnifying power of 50. Five grades were used for evaluation of pepper susceptibility. Grade A is the best of all the grades (i.e., the grade given to a film which is substantially free from any pepper), and Grade E the worst. A Grade A or B film is practically useful and a Grade C film is acceptable for practical use despite its low quality, while Grade D or E film is not acceptable for practical use.

As is obvious from TABLE 2, all of Samples Nos. 11 to 19 embodying this invention showed a high level of sensitivity and a high contrast or gamma value exceeding 10. On the other hand, all of samples Nos. 2 to 10 and 21-a) to 21-d) containing the comparative compounds (A) to (D), (F) to (H), (J) to (N), and (P) respectively, gave only a very low gamma value. In particular, it is unexpected and surprising that both of the compounds (A), (C), and (D) which are disclosed in Japanese Patent Applications Nos. 83,028/1985, 93,433/1985, 222,241/1987, etc. and U.S. Pat. No. 4,681,836, and the compounds (L), (M), (N), and (P) substituted with an acylamino group, an ureido group, or a thioureido group, all of which are often employed as a useful substituent for an 1-formyl-2-phenylhydrazine derivative (e.g., U.S. Pat. Nos. 4,166,742, 4,243,739, 4,323,643, etc.) did not give a high contrast.

Moreover, all of the samples of this invention were substantially free from any pepper. On the other hand, both of Samples Nos. 20 and 21 containing the comparative compound (E) produced only an image of low quality with many peppers, though they showed a high level of sensitivity and a high contrast.

TABLE 1

| Sample No. | Compound | Amount, mol per mole of Ag |
|---|---|---|
| 1 | — | — |
| 2 | Comparative compound (A) | $1 \times 10^{-2}$ |
| 3 | Comparative compound (B) | $1 \times 10^{-2}$ |
| 4 | Comparative compound (C) | $1 \times 10^{-2}$ |
| 5 | Comparative compound (D) | $1 \times 10^{-2}$ |
| 6 | Comparative compound (F) | $1 \times 10^{-2}$ |
| 7 | Comparative compound (G) | $1 \times 10^{-2}$ |
| 8 | Comparative compound (H) | $1 \times 10^{-2}$ |
| 9 | Comparative compound (J) | $1 \times 10^{-2}$ |
| 10 | Comparative compound (K) | $1 \times 10^{-2}$ |
| 11 | I-1 | $2 \times 10^{-3}$ |
| 12 | I-1 | $8 \times 10^{-3}$ |
| 13 | I-9 | $5 \times 10^{-3}$ |
| 14 | I-10 | $3 \times 10^{-3}$ |
| 15 | I-12 | $3 \times 10^{-3}$ |
| 16 | II-3 | $4 \times 10^{-3}$ |
| 17 | II-4 | $1.1 \times 10^{-2}$ |
| 18 | II-6 | $8 \times 10^{-3}$ |
| 19 | II-8 | $8 \times 10^{-3}$ |
| 20 | Comparative compound (E) | $2.5 \times 10^{-3}$ |
| 21 | Comparative compound (E) | $8 \times 10^{-3}$ |
| (21-a) | Comparative compound (L) | $5 \times 10^{-3}$ |
| (21-b) | Comparative compound (M) | $1.5 \times 10^{-3}$ |
| (21-c) | Comparative compound (N) | $1.5 \times 10^{-3}$ |
| (21-d) | Comparative compound (P) | $1 \times 10^{-2}$ |

Comparative Compounds

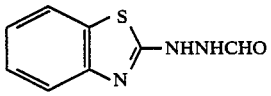
(A)

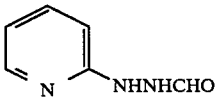
(B)

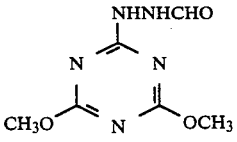
(C)

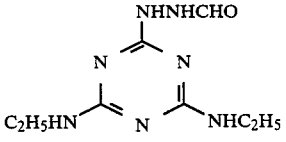
(D)

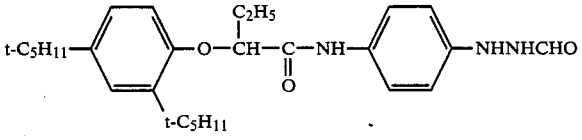
(E)

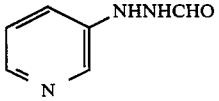
(F)

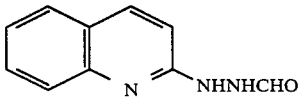
(G)

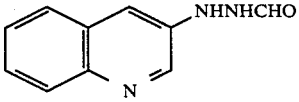
(H)

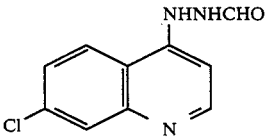
(J)

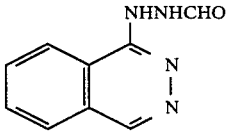
(K)

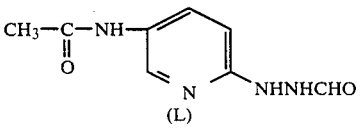
(L)

TABLE 1-continued

| Sample No. | Compound | Amount, mol per mole of Ag |
|---|---|---|
| | 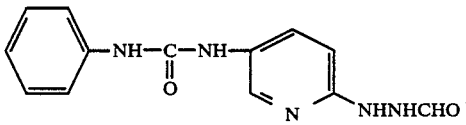 (M) | |
| | 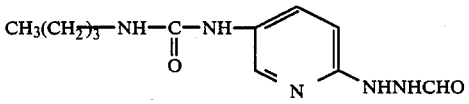 (N) | |
| | 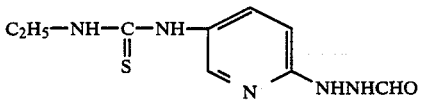 (N) | |

TABLE 2

| Sample No. | Relative sensitivity | Fog | Contrast (gamma) | Pepper |
|---|---|---|---|---|
| 1 | 100 | 0.03 | 5.0 | — |
| 2 | 105 | 0.03 | 5.1 | — |
| 3 | 194 | 0.04 | 5.8 | — |
| 4 | 148 | 0.04 | 4.5 | — |
| 5 | 138 | 0.03 | 5.4 | — |
| 6 | 162 | 0.04 | 4.1 | — |
| 7 | Heavily fogged | | | |
| 8 | 200 | 0.04 | 4.8 | — |
| 9 | 302 | 0.04 | 6.0 | — |
| 10 | 214 | 0.26 | 5.0 | — |
| 11 | 562 | 0.04 | 11.4 | A |
| 12 | 676 | 0.04 | 20.8 | A |
| 13 | 708 | 0.04 | 25.0 | A |
| 14 | 724 | 0.04 | 19.2 | A |
| 15 | 759 | 0.04 | 19.6 | A |
| 16 | 759 | 0.03 | 19.2 | A |
| 17 | 631 | 0.03 | 16.7 | A |
| 18 | 646 | 0.04 | 17.9 | A |
| 19 | 631 | 0.04 | 16.7 | A |
| 20 | 490 | 0.04 | 20.8 | C |
| 21 | 813 | 0.04 | 15.6 | C |
| 21-a | 78 | 0.04 | 4.2 | — |
| 21-b | 316 | 0.06 | 3.8 | — |
| 21-c | 257 | 0.03 | 3.9 | — |
| 21-d | 51 | 0.44 | 4.2 | — |

EXAMPLE 2

Three monodispersed cubic silver halide emulsions having a means grain size of 0.2 micron were prepared by the same procedure as employed in EXAMPLE 1, except that a chemical ripening temperature of 57° C. was employed. They were each of the following silver halide composition:

| | Molar ratio of AgCl:AgBr:AgI |
|---|---|
| Emulsion 1 | 0:98:2 |
| Emulsion 2 | 5:95:0 |
| Emulsion 3 | 20:80:0 |

Compound I-1 embodying this invention or Comparative Compound (E) was added to each of Emulsions 1 to 3 and samples No. 22 to 27 were prepared by the same procedure as employed in EXAMPLE 1, as shown in TABLE 3. The procedures of EXAMPLE 1 were also employed for exposing, developing and evaluating each sample film. The results of evaluation are shown in TABLE 3.

As is obvious from TABLE 3, all of Samples Nos. 22, 24 and 26 embodying this invention showed a high gamma value exceeding 10 without the appearance of pepper.

TABLE 3

| Sample No. | Emulsion No. | Compound; mol per mol of Ag | Relative sensitivity | Contrast (gamma) | Fog | Pepper |
|---|---|---|---|---|---|---|
| 22 | 1 | I - 1; $5 \times 10^{-3}$ | 100 | 17.4 | 0.05 | B |
| 23 | 1 | Comparative (E); $8 \times 10^{-3}$ | 158 | 35.5 | 0.03 | D |
| 24 | 2 | I - 1; $5 \times 10^{-3}$ | 145 | 20.8 | 0.04 | A |
| 25 | 2 | Comparative (E); $8 \times 10^{-3}$ | 166 | 25.0 | 0.04 | C |
| 26 | 3 | I - 1; $5 \times 10^{-3}$ | 129 | 22.7 | 0.04 | A |
| 27 | 3 | Comparative (E); $8 \times 10^{-3}$ | 158 | 41.7 | 0.04 | D |

EXAMPLE 3

Samples Nos. 28 to 30 were prepared by employing the procedures of EXAMPLES 1 and 2, except that neither of the compounds according to this invention nor the comparative compounds were added to any of Emulsions 1 to 3. The coating samples were exposed in the same manner as in EXAMPLE 1 and then were developed at 29.4° C. for 15 seconds by a developer which had been prepared by adding $5 \times 10^{-3}$ mol of Compound I-1 or II-3, or Comparative Compound (C) or (E) per liter to the developer of EXAMPLE 1. The photographic properties were evaluated in the same manner as in EXAMPLE 1 or 2, and the results obtained are shown in TABLE 4.

TABLE 4

| Sample No. | Emulsion No. | Compound | Relative sensitivity | Contrast (gamma) | Fog | Pepper |
|---|---|---|---|---|---|---|
| 28 | 1 | Comparative (E) | 100 | 13.3 | 0.03 | C |
| 28 | 1 | Comparative (C) | 10 | 4.0 | 0.04 | — |

TABLE 4-continued

| Sample No. | Emulsion No. | Compound | Relative sensitivity | Contrast (gamma) | Fog | Pepper |
|---|---|---|---|---|---|---|
| 28 | 1 | I - 1 | 117 | 16.9 | 0.03 | B |
| 28 | 1 | II - 3 | 121 | 15.4 | 0.03 | A |
| 29 | 2 | I - 1 | 66 | 10.9 | 0.03 | A |
| 29 | 2 | II - 3 | 72 | 11.5 | 0.03 | A |
| 30 | 3 | I - 1 | 71 | 10.3 | 0.03 | A |
| 30 | 3 | II - 3 | 80 | 10.8 | 0.03 | A |

As is obvious from TABLE 4, according to this invention the addition of the compounds of formulas I or II to the developer was effective in achieving a high gamma value exceeding 10, while substantially preventing the appearance of any pepper, but the addition of the known compound (C) to the developer failed to provide any high gamma value. The developer containing the known compound (E) could form only an image of low quality with a lot of peppers, though it had a high contrast.

What is claimed is:

1. A silver halide photographic light-sensitive material containing at least one negative-working silver halide photographic emulsion layer comprising substantially surface latent image type monodispersed silver halide grains, said material containing a compound represented by formula I or II:

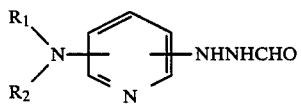

[I]

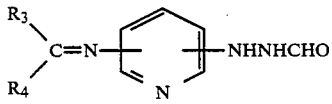

[II]

wherein each of $R_1$, $R_2$, $R_3$ and $R_4$ represents a hydrogen atom, a substituted or unsubstituted alkyl group, or a substituted or unsubstituted aryl group provided that if one of $R_3$ and $R_4$ is a hydrogen atom, the other cannot be a hydrogen atom.

2. A silver halide photographic light-sensitive material as set forth in claim 1, wherein the silver halide photographic emulsion layer contains the compound of formula I.

3. A silver halide photographic light-sensitive material as set forth in claim 1, wherein the silver halide photographic emulsion layer contains the compound of formula II.

4. A silver halide photographic light-sensitive material as set forth in claim 1, wherein the alkyl group is a linear alkyl group.

5. A silver halide photographic light-sensitive material as set forth in claim 1, wherein the alkyl group is a branched alkyl group.

6. A silver halide photographic light-sensitive material as set forth in claim 1, wherein the alkyl group is a cyclic alkyl group.

7. A silver halide photographic light-sensitive material as set forth in claim 1, wherein the alkyl group has 1 to 20 carbon atoms.

8. A silver halide photographic light-sensitive material as set forth in claim 4, wherein the linear alkyl group is a methyl group, an ethyl group, a n-propyl group, a n-butyl group or a n-hexyl group.

9. A silver halide photographic light-sensitive material as set forth in claim 5, wherein the branched alkyl group is an iso-propyl group or a t-butyl group.

10. A silver halide photographic light-sensitive material as set forth in claim 6, wherein the cyclic alkyl group is a cyclohexyl group or a cyclopentyl group.

11. A silver halide photographic light-sensitive material as set forth in claim 1, wherein the substituent in the substituted alkyl group is a monocyclic or bicyclic unsubstituted aryl group.

12. A silver halide photographic light-sensitive material as set forth in claim 1, wherein the substituent in the substituted alkyl group is a monocyclic or bicyclic substituted aryl group.

13. A silver halide photographic light-sensitive material as set forth in claim 1, wherein the substituent in the substituted alkyl group is a heterocyclic or a heterocyclicthio group.

14. A silver halide photographic light-sensitive material as set forth in claim 1, wherein the substituent in the substituted alkyl group is a halogen atom.

15. A silver halide photographic light-sensitive material as set forth in claim 1, wherein the substituent in the substituted alkyl group is a hydroxyl group.

16. A silver halide photographic light-sensitive material as set forth in claim 1, wherein the substituent in the substituted alkyl group is an alkoxy group.

17. A silver halide photographic light-sensitive material as set forth in claim 11, wherein the monocyclic unsubstituted aryl group is a phenyl group.

18. A silver halide photographic light-sensitive material as set forth in claim 11, wherein the bicyclic unsubstituted aryl group is a naphthyl group.

19. A silver halide photographic light-sensitive material as set forth in claim 12, wherein the monocyclic substituted aryl group is a 4-methylphenyl group, a 4-iso-propylphenyl group, a 4-hydroxyphenyl group, a 4-hydroxy-3,5,-di-t-butylphenyl group, a 4-methoxyphenyl group, a 4-aminophenyl group, a 4-N,N-dimethylureidophenyl group or a 4-methylthiophenyl group.

20. A silver halide photographic light-sensitive material as set forth in claim 14, wherein the halogen atom is a chlorine atom, a fluorine atom or a bromine atom.

21. A silver halide photographic light-sensitive material as set forth in claim 16, wherein the alkoxyl group is a methoxy group, an ethoxy group, a n-propoxy group, an isopropoxy group, a n-butoxy group or a t-butoxy group.

22. A silver halide photographic light-sensitive material as set forth in claim 1, wherein the substituted alkyl group is a benzyl group, a phenethyl group, a 2-chloroethyl group, a 2-methoxyethyl group, a 2-hydroxylethyl group, a 4-methylbenzyl group, a 4-iso-propylbenzyl group, a 4-hydroxybenzyl group, a 4-methoxybenzyl group, a 4-aminobenzyl group, a 4-N,N-dimethylureidobenzyl gorup, a 1-naphthylmethyl group or a 2-naphthylmethyl group.

23. A silver halide photographic light-sensitive material as set forth in claim 13, wherein the heterocyclic or the heterocyclicthio group is a 5-methylbenzotriazol-l-yl group, a 2-benzothiazolyl group, a 1-benzimidazoyl group, a 5-nitroindazol-l-yl group or a 1-phenyltetrazol-5-yl-thio group.

24. A silver halide photographic light-sensitive material as set forth in claim 1, wherein the substituent in the substituted aryl group is an alkyl group having 1 to 10 atoms.

25. A silver halide photographic light-sensitive material as set forth in claim 1, wherein the substituent in the substituted aryl group is an alkoxyl group having 1 to 10 carbon atoms.

26. A silver halide photographic light-sensitive material as set forth in claim 1, wherein the substituent in the substituted aryl group is a halogen atom.

27. A silver halide photographic light-sensitive material as set forth in claim 1, wherein the substituent in the substituted aryl group is a hydroxy group.

28. A silver halide photographic light-sensitive material as set forth in claim 1, wherein the substituent in the substituted aryl group is an amino- or substituted amino group.

29. A silver halide photographic light-sensitive material as set forth in claim 1, wherein the substituent in the substituted aryl group is a ureido group.

30. A silver halide photographic light-sensitive material as set forth in claim 1, wherein the substituted aryl group is a 4-methylphenyl group, a 3-methylphenyl group, an 2-methylphenyl group, a 4-isopropylphenyl group, a 4-methylthiophenyl group, a 4-chlorophenyl group, a 4-methoxyphenyl group, a 4-aminophenyl group, a 4-acetylaminophenyl group, a 4-hydroxyphenyl group, an 2-hydroxyphenyl group or a 4-N,N-dimethylureidophenyl group.

31. A silver halide photographic light-sensitive material as set forth in claim 1, wherein each of the formylhydrazino groups in formulas I or II is located in the 2-position of the pyridine ring.

32. A silver halide photographic light-sensitive material as set forth in claim 1, wherein the compound of formula I is a compound represented by the formula:

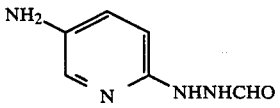

33. A silver halide photographic light-sensitive material as set forth in claim 1, wherein the compound of formula I is a compound represented by the formula:

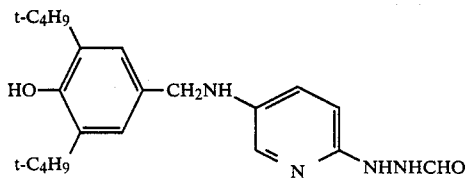

34. A silver halide photographic light-sensitive material as set forth in claim 1, wherein the compound of formula I is a compound represented by the formula:

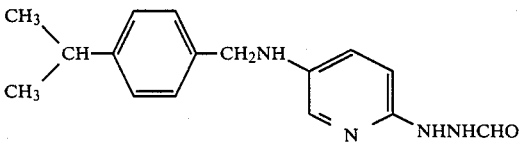

35. A silver halide photographic light-sensitive material as set forth in claim 1, wherein the compound of formula I is a compound represented by the formula:

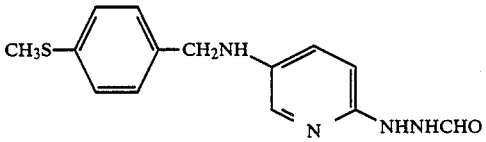

36. A silver halide photographic light-sensitive material as set forth in claim 1, wherein the compound of formula II is a compound represented by the formula:

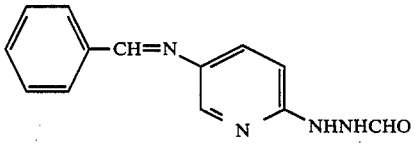

37. A silver halide photographic light-sensitive material as set forth in claim 1, wherein the compound of formula II is a compound represented by the formula:

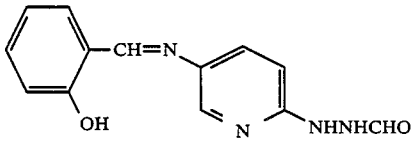

38. A silver halide photographic light-sensitive material as set forth in claim 1, wherein the compound of formula II is a compound represented by the formula:

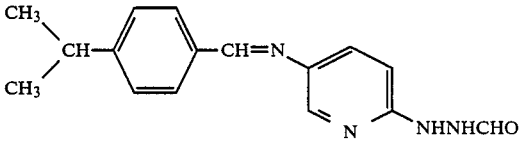

39. A silver halide photographic light-sensitive material as set forth in claim 1, wherein the compound of formula II is a compound represented by the formula:

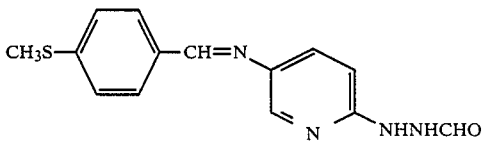

40. A silver halide photographic light-sensitive material as set forth in claim 1, wherein said material has another hydrophilic colloidal layer containing the compound of formula I or II.

41. A silver halide photographic light-sensitive material as set forth in claim 1, wherein the content of the compound of formula I ranges from $1\times10^{-5}$ to $1\times10^{-1}$ mol per mol of silver halide.

42. A silver halide photographic light-sensitive material as set forth in claim 1, wherein the content of the compound of formula II ranges from $1\times10^{-5}$ to $1\times10^{-1}$ mol per mol of silver halide.

43. A silver halide photographic light-sensitive material as set forth in claim 1, wherein the silver halide is silver chloride, silver bromide, silver chlorobromide, silver iodobromide or silver iodochlorobromide.

44. A silver halide photographic light-sensitive material as set forth in claim 1, wherein the silver halide photographic emulsion layer contains a binder in a quantity of not exceeding 250 g per mol of silver halide.

45. A silver halide photographic light-sensitive material as set forth in claim 1, wherein the silver halide grains comprise silver bromide in an amount of at least 50 mol % of the total amount.

46. A silver halide photographic light-sensitive material as set forth in claim 1, wherein the silver halide grains comprise silver bromide in an amount of at least 70 mol % of the total amount.

47. A silver halide photographic light-sensitive material as set forth in claim 1, wherein the silver halide grains comprise silver bromide in an amount of not less than 70 mol % and silver iodide in an amount not exceeding 10 mol %, both based on the total amount.

48. A silver halide photographic light-sensitive material as set forth in claim 1, wherein the silver halide photographic emulsion layer contains silver halide grains prepared in the presence of an iridium salt.

49. A silver halide photographic light-sensitive material as set forth in claim 1, wherein the silver halide photographic emulsion layer contains silver halide grains prepared in the presence of a rhodium salt.

50. A silver halide photographic light-sensitive material as set forth in claim 1, wherein the silver halide grains have an average size of 0.1 to 0.7 micron.

51. A process for forming a photographic image comprising:

exposing to light a silver halide photographic light-sensitive material containing at least one negative-working silver halide emulsion layer composed of substantially surface latent image type monodispersed silver halide grains; and treating said material with a developer in the presence of the compound of formula I or II:

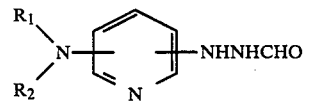

[I]

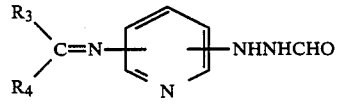

[II]

wherein each of $R_1$, $R_2$, $R_3$ and $R_4$ represents a hydrogen atom, a substituted or unsubstituted alkyl group, or a substituted or unsubstituted aryl group, provided that if one of $R_3$ and $R_4$ is a hydrogen atom, the other cannot be a hydrogen atom.

52. A process as set forth in claim 51, wherein the developer contains at least 0.15 mol of sulfite ion per liter and has a pH of 11 to 12.5.

53. A process as set forth in claim 51, wherein the silver halide photographic emulsion layer contains the compound of formula I.

54. A process as set forth in claim 51, wherein the silver halide photographic emulsion layer contains the compound of formula II.

55. A process as set forth in claim 51, wherein the silver halide photographic light-sensitive material has another hydrophilic colloidal layer containing the compound of formula I.

56. A process as set forth in claim 51, wherein the silver halide photographic light-sensitive material has another hydrophilic colloidal layer containing the compound of formula II.

57. A process as set forth in claim 51, wherein the developer contains the compound of formula I.

58. A process as set forth in claim 51, wherein the developer contains the compound of formula II.

59. A process as set forth in claim 51, wherein the developer contains hydroquinone.

60. A process as set forth in claim 51, wherein the developer contains hydroquinone and a 3-pyrazolidone.

61. A process as set forth in claim 51, wherein the developer contains hydroquinone and an aminophenol.

* * * * *